United States Patent [19]

Mileti

[11] Patent Number: 4,781,345

[45] Date of Patent: Nov. 1, 1988

[54] KITE STRUT

[76] Inventor: Robert J. Mileti, 21 Taylor St., Torrington, Conn. 06790

[21] Appl. No.: 62,873

[22] Filed: Jun. 16, 1987

[51] Int. Cl.[4] ..... G64C 31/06

[52] U.S. Cl. ..... 244/155 R; 244/153 R; 403/273

[58] Field of Search ..... 244/153 R; 403/273

[56] References Cited

U.S. PATENT DOCUMENTS

| | | | |
|---|---|---|---|
| 2,422,804 | 6/1947 | Schroeder | 244/153 R |
| 3,534,932 | 10/1970 | Chrisstoffel et al. | 244/153 R |
| 3,570,792 | 3/1971 | Chrisstoffel et al. | 244/153 R |
| 3,582,457 | 6/1971 | Barthell | 403/273 |
| 3,932,926 | 1/1976 | Dotsko | 403/273 |
| 4,072,284 | 2/1978 | Arnstein | 244/153 R |
| 4,159,087 | 6/1979 | Moomaw | 244/153 R |
| 4,236,281 | 12/1980 | Bottum | 403/273 |

*Primary Examiner*—Galen Barefoot

*Attorney, Agent, or Firm*—St Onge Steward Johnston & Reens

[57] ABSTRACT

A kite strut is presented. More particularly, a kite strut comprising an elongate rod having two end portions and further having at least one shrink fit stop ring disposed thereabout, said stop ring comprising an annular segment of heat shrinkable material which is shrunk into a shrink fit relationship with the elongate rod, is presented. Also presented is a method of making such kite struts.

21 Claims, 1 Drawing Sheet

KITE STRUT

DESCRIPTION

1. Technical Field

The present invention relates to kite struts, and especially kite struts having at least one stop ring disposed thereabout. Moreover, the present invention relates to a method of making such kite struts.

In making kites, it is known to provide a plurality of kite struts, usually two, in the form of a cross over which an amount of material such as paper or cloth is laid and to which such material is secured. The kite struts provide the kite with its structural integrity. Typically, one of such struts is longer than the other. Kite struts are generally also used as a place for the attachment of string used for control of the kite and the kite tail, which provides aerodynamic stability to the kite.

Typical kite struts are generally wooden or plastic rods which do not provide means for preventing undesirable movement of the kite struts relative to each other. Furthermore, in typical kites, sliding of the string or tail along the strut to which they are attached is undesired and comprises a significant disadvantage.

2. Disclosure of Invention

An object of the present invention is to provide a kite strut which substantially avoids the disadvantages of prior art kite struts.

Another object of the present invention is to provide a kite strut which permits easier assembly of a kite and provides the consumer with a kite which is relatively easy to control and yet has the flexibility required in a kite.

A further object of the present invention is to provide a kite strut which provides these advantages and can be manufactured efficiently and inexpensively.

These and other objects of the invention which will be apparent upon a reading of this disclosure are accomplished by the provision of a kite strut which comprises an elongate rod having two end portions and further having at least one shrink fit stop ring disposed thereabout. The shrink fit stop ring comprises an annular segment of heat shrinkable material which is shrunk into a shrink fit relationship with the elongate rod.

The present invention further comprises a method of making the kite strut. The method involves providing an elongate rod having two end portions, providing at least one heat shrinkable stop ring which comprises an annular segment of heat shrinkable material, disposing the stop ring at a desired position about the elongate rod and heating the stop ring while it is disposed about the rod under conditions effective to cause the stop ring to shrink and assume a shrink fit relationship with the rod.

BRIEF DESCRIPTION OF THE DRAWINGS

The present invention will be better understood and its advantages more apparent in view of the following detailed description, especially when read in reference to the appended drawings, wherein.

BEST MODE FOR CARRYING OUT THE INVENTION

As used herein, the term "shrink fit" refers to the characteristic of the fit of an annular member wherein it has negative allowance so that the diameter of the hole of the annular member is less than the diameter of a shaft or rod that is to pass through the hole; the term "heat shrinkable" refers to the characteristic of a material to contract upon heating and maintain such contracted state after cooling, as used herein the contraction of the material should be sufficient to establish a shrink fit relationship with a substrate; the term "thermoplastic" refers to a characteristic of a material to become soft upon heating and to reharden when cooled; the term "polyolefin" refers to a class of thermoplastic polymers derived from simple olefins, such as polyethylene, polypropylene, etc.

Figure 1:
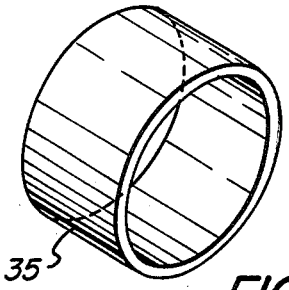
FIG. 1 is an isometric view of an annular segment of heat shrinkable material which is used to form the stop ring of this invention.
Figure 2:
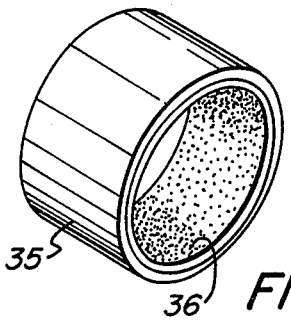
FIG. 2 is an isometric view of an annular segment of heat shrinkable material which is lined on its inner diameter with a layer of an adhesive.
Figure 7:
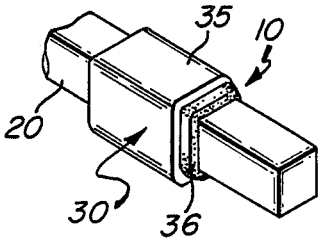
FIG. 7 is a partially broken aaway isometric view of an alternate embodiment of a kite strut according to this invention having a stop ring disposed thereabout.

The kite strut 10 of the present invention comprises an elongate rod 20 having two end portions 21 and 22, as illustrated in FIGS. 1 and 2. Elongate rods suitable for use in this invention are any rods having the appropriate length, diameter and structural stability for use as a kite strut. Although elongate rod 20 used to form kite strut 10 is preferably circular in cross-section as illustrated in FIG. 4, it will be understood that elongate rod 20 can have other cross-sectional shapes, such as rectangular, as illustrated in FIG. 7.

Typically, kite strut 10 is about two feet to about four feet in length, although this can vary greatly as desired. The diameter (or, generally, cross-sectional dimension) or rod is less important than its length and is significant mainly in terms of providing elongate rod 20 with its structural stability and, as is apparent, depends in large part on the nature of the material which forms rod 20. In other words, any diameter of rod 20 which provides the desired structural stability is appropriate. Usually, elongate rod 20 has a diameter of about 0.010 to about 0.015 inches.

The structural stability of elongate rod 20 is probably its most important characteristic. As would be known to the skilled artisan, kite strut 10 should have sufficient structural stability to provide a kite having dimensional stability and the strength to withstand the relatively violent forces of the wind which will effect the kite when in use. Preferably, strut 10 will have the ability to bow and flex upon being subjected to wind forces, yet will not easily break. Although it is known to make kites having struts of elongate rods made of wood, and such wooden struts are suitable for use as elongate rod 20 in the present invention, it is preferred that elongate rod 20 be made of a plastic material, and is most preferably a plastic material reinforced with fiberglass due to the structural stability, flexibility and general availability of such plastic materials which can easily be formed into rod 20 for use as kite strut 10 by methods conventional in the art.

Figure 4:
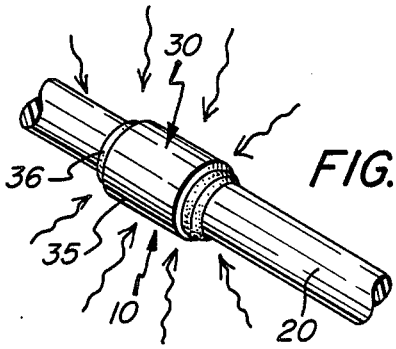
FIG. 4 is a partially broken away isometric view of a kite strut according to this invention having a stop ring disposed thereabout.
Figure 5:
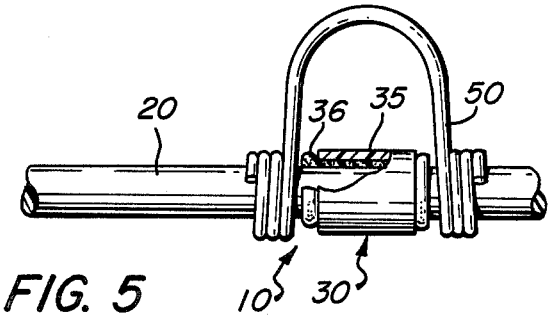
FIG. 5 is a partially broken away side elevation view of a kite strut according to this invention having a stop ring disposed thereabout and a string attachment eyelet anchored by the stop ring.
Figure 6:
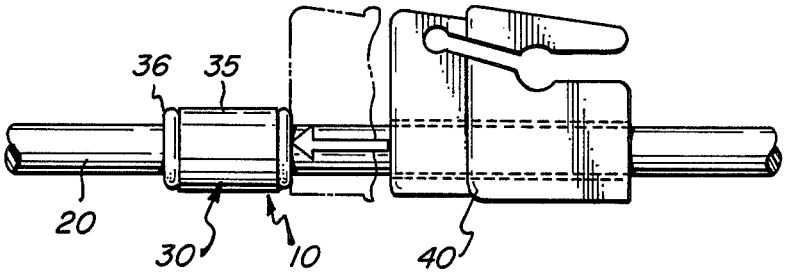
FIG. 6 is a side elevation view of a kite strut according to this invention having a stop ring disposed thereabout, the stop ring used to prevent the sliding motion of a member along the kite strut past the stop ring.

Kite strut 10 of this invention further comprises at least one shrink fit stop ring 30 disposed about elongate rod 20, as illustrated in FIGS. 4–6. Stop ring 30 comprises an annular segment of heat shrinkable material 35 which is shrunk into a shrink fit relationship with elongate rod 20. Heat shrinkable material suitable for use as stop ring 30 can be any material which can be heat shrunk by heating to a heat shrink temperature which is specific for the material used for form annular segment 35, to assume a shrink fit relationship with elongate rod 20. Advantageously, the annular segment of heat shrinkable material 35 comprises a thermoplastic material such as a polyolefin which, when heated, contracts and, assuming the pre-shrinkage diameter of annular segment 35 is properly chosen as discussed in more detail below, shrinks around rod 20 to form a shrink fit relationship therewith. Moreover, the themoplastic nature of annular segment 35 permits it to conform to any cross-sectional shape when contracted, permitting the use of any shape of elongate rod 20, as discussed above.

As mentioned above, the diameter of annular segment 35 used for heat shrinkable material must be chosen with reference to its intended use. It will be apparent that the diameter of elongate rod 20 is an important parameter to be used in choosing the diameter of annular segment 35 used to form stop ring 30, otherwise a shrink fit relationship may not be established. The diameter of annular segment 35 is chosen with regard to the diameter of rod 20 and also with regard to the heat shrinking properites of the material, i.e., how much the material can be expected to contract when heated. When elongate rod 20 comprises a plastic rod having a diameter of about 0.10 to about 0.15 inches as described above, and stop ring 30 is formed of a polyolefin, the diameter of annular segment 35 prior to shrinkage, illustrated in FIG. 1, is preferably about 0.15 to about 0.35 inches to ensure a shrink fit relationship between stop ring 30 and rod 20.

Advantageously, stop ring 30 is disposed from about one to about fourteen inches from an end portion 21 or 22 of elongate rod 20 used to form kite strut 10. Moreover, it is preferred to use a plurality of stop rings 30 in forming kite strut 10 of this invention, most preferably two. In this way, a first stop ring 30 can be used to stop the motion of one kite strut relative to the other, as will be discussed in more detail below, and a second stop ring 30 can be used as an anchor for a string attachment eyelet and also to stop the motion of one kite strut relative to the other, as will also be discussed in more detail below.

In a preferred embodiment of this invention, annular segment 35 is lined on its inner diameter with a layer of an adhesive 36, as illustrated in FIG. 2. Such layer of adhesive 36 should advantageously line the entire inner diameter of annular segment 35, as illustrated. Most preferably, adhesive 36 should be a thermoplastic adhesive which melts at the shrink fit temperature of annular segment of heat shrinkable material 35 and covers the area of elongate rod 20 over which stop ring 30 is disposed, as illustrated in FIG. 5. Upon cooling, adhesive 36 then hardens to securely adhere stop ring 30 to rod 20.

It is desired to line the inner diameter of annular segment 35 with a sufficient amount of adhesive 36 so that, upon contraction of annular segment 35 into the shrink fit relationship with elongate rod 20, adhesive 36 squeezes out between stop ring 30 and rod 20, as illustrated in FIGS. 4–6, to ensure that adequate adhesion is provided.

Figure 3:
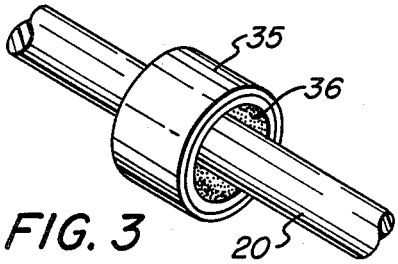
FIG. 3 is a partially broken away isometric view of an elongate rod having an annular segment of heat shrinkable material disposed thereabout prior to heating.

Advantageously in making the kite strut 10 of this invention, elongate rod 20, as described above, is first provided. Next provided, as also above described, is annular segment of heat shrinkable material 35 for use as stop ring 30. Annular segment 35 is disposed about elongate rod 20 at the desired position as illustrated in FIG. 3 and then heated under conditions effective to cause stop ring 30 to contract or shrink and assume a shrink fit relationship with rod 20, as illustrated in FIG. 4.

The apparatus used to heat annular segment 35 to form stop ring 30 can be any conventional heating apparatus, such as a heater shroud oven (not shown), as would be familiar to the skilled artisan. Of course, the temperature to which annular segment 35 is heated depends on the material which comprises annular segment 35. If a polyolefin is used to comprise annular segment of heat shrinkable material 35, as described above, the shrink temperature is above about 200° F., preferably above about 250° F. to obtain the shrink fit relationship between stop ring 30 and elongate rod 20.

Use of kite strut 10 of the present invention provides many distinct advantages. For instance, it is desirable to produce a kite wherein the two kite struts are in a slidable relationship to each other. This is desired because the stresses to which a kite is exposed while in use can cause bowing and other flexing effects. Without a slidable relationship, such bowing and flexing could potentially damage one or both kite struts. Stop ring 30 provides a means for preventing one of the struts of a kite from sliding to an undesirably large extent with respect to the other while still allowing the desirable sliding. For example, as illustrated in FIG. 6, if kite strut 10 has disposed thereon a sliding member 40 which is used to secure the second kite strut to kite strut 10, as is conventional, stop ring 30 prevents sliding member 40 from sliding beyond stop ring 30. Moreover, if a second stop ring is used, the second kite strut can be maintained within a desired section of kite strut 10, thereby providing increased ease of handling of the kite.

Another advantage flowing from the use of kite strut 10 of this invention is as an anchor for a string attachment eyelet 50, as illustrated in FIG. 5. String attachment eyelet 50, as is conventionally known, comprises a looped length of wire the ends of which are wound around kite strut 10. By use of stop ring 30, string attachment eyelet 50 can be wound around kite strut 10 on either side of stop ring 30, which thereby anchors string attachment eyelet 50 at a predetermined position on kite strut 10. Control string or the like can then be attached to string attachment eyelet 50.

A further advantage derived from the present invention is in the ease, convenience and inexpensiveness of manufacture of kite strut 10 and kites made therefrom using the disclosure of this invention. A heating step, as discussed above, performs the task of securing stop ring 30 to elongate rod 20. This heating step provides an easy and convenient method of securing stop ring 30 to elongate rod 20 in a way which does not require a great deal of time or manpower.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

I claim:

1. A kite strut comprising an elongate rod having two end portions and further having at least one shrink fit stop ring disposed therebout, said stop ring comprising an annular segment of heat shrinkable material shrunk permanent into a shrink fit relationship with said elongate rod.

2. The kite strut of claim 1 wherein said heat shrinkable material comprises a thermoplastic material.

3. The kite strut of claim 2 wherein said thermoplastic material comprises a polyolefin.

4. The kite strut of claim 1 wherein said annular segment of heat shrinkable material has an inner diameter prior to shrinkage of about 0.15 to about 0.35 inches.

5. The kite strut of claim 4 wherein said annular segment of heat shrinkable material is about 0.10 to about 0.30 inches in length.

6. The kite in claim 1 wherein said annular segment of heat shrinkable material is lined on its inner diameter with a layer of an adhesive.

7. The kite strut of claim 6 wherein said adhesive comprises a thermoplastic adhesive.

8. The kite strut of claim 1 wherein elongated rod is about two feet to about four feet in length.

9. The kite strut of claim 8 wherein said elongate rod is about 0.10 inches to about 0.15 inches in diameter.

10. The kite strut of claim 8 wherein said stop ring is disposed about one inch to about fourteen inches form an end portion of said elongate rod.

11. A method of making a kite strut comprising:

(i) providing an elongate rod having two end portions;

(ii) providing at least one heat shrinkable stop ring comprising an annular segment of heat shrinkable material;

(iii) disposing said stop ring at a desired position about said elongate rod; and (iv) heating said stop ring while disposed about said elongate rod under conditions effective to cause said stop ring to shrink permanent and thereby assume a shrink fit relationship with said elongate rod.

12. The method of claim 11 wherein said heat shrinkable material comprises a thermoplastic.

13. The method of claim 12 wherein said thermoplastic comprises a polyolefin.

14. The method of claim 11 wherein said stop ring is lined on its inner diameter with a layer of an adhesive.

15. The method of claim 14 wherein said adhesive comprises a thermoplastic adhesive.

16. The method of claim 11 wherein said stop ring has an inner diameter prior to shrinkage of about 0.15 to about 0.35 inches.

17. The method of claim 16 wherein said stop ring is about 0.10 to about 0.30 inches in length.

18. The method of claim 14 wherein during the heating step, said adhesive melts and covers the area of said elongate rod over which said stop ring is disposed.

19. The method of claim 11 wherein said elongate rod is about two feet to about four feet in length.

20. The method of claim 19 wherein said elongate rod is about 0.10 inches to about 0.15 inches in diameter.

21. The method of claim 19 wherein said stop ring is disposed about one to about fourteen inches from an end portion of said elongate rod.

* * * * *